US006577240B2

(12) United States Patent
Armstrong

(10) Patent No.: US 6,577,240 B2
(45) Date of Patent: Jun. 10, 2003

(54) HAND ANTISEPTIC SYSTEM AND METHOD

(76) Inventor: David N. Armstrong, 7410 Princeton Trace, Atlanta, GA (US) 30328

( * ) Notice: Subject to any disclaimer, the term of this patent is extended or adjusted under 35 U.S.C. 154(b) by 13 days.

(21) Appl. No.: 09/892,982

(22) Filed: Jun. 27, 2001

(65) Prior Publication Data

US 2002/0000449 A1 Jan. 3, 2002

Related U.S. Application Data

(60) Provisional application No. 60/215,328, filed on Jun. 30, 2000.

(51) Int. Cl.[7] ..... G08B 23/00
(52) U.S. Cl. ..... 340/573.1; 4/222
(58) Field of Search ..... 340/573.1, 572.3, 340/286.09, 541, 567; 222/39; 4/222, 223; 382/100

(56) References Cited

U.S. PATENT DOCUMENTS 5,202,666 A * 4/1993 Knippacheer ..... 340/573.1
5,695,091 A 12/1997 Winings et al. ..... 222/1
5,812,059 A * 9/1998 Shaw et al. ..... 340/573.1
6,038,331 A * 3/2000 Johnson ..... 382/100
6,236,317 B1 * 5/2001 Cohen et al. ..... 340/573.1
6,347,414 B2 * 2/2002 Contadini et al. ..... 4/222

* cited by examiner

*Primary Examiner*—Van Trieu
(74) *Attorney, Agent, or Firm*—Thomas, Kayden, Horstemeyer & Risley

(57) ABSTRACT

A pair of sensors (20A and 20B) are mounted at the entrance to a germ sensitive area. When a person enters the area the sensors are activated in sequence, indicating the direction of movement of the person. An indicator, such as a light or sound alarm is mounted upon an antiseptic dispenser, located within the area. The alarm is actuated by the movement and is de-activated once antiseptic is dispensed from the unit. Likewise when the person moves out of the germ sensitive area, the alarm on a dispenser unit located outside the area is energized and is de-activated upon dispensing of antiseptic.

25 Claims, 4 Drawing Sheets

HAND ANTISEPTIC SYSTEM AND METHOD

CROSS-REFERENCE TO RELATED APPLICATION

This application claims priority to copending U.S. provisional application entitled, "Hand Antiseptic Alarm," having Serial No. 60/215,328, filed Jun. 30, 2000, which is entirely incorporated herein by reference.

TECHNICAL FIELD

The present invention is generally related to hand hygiene. More particularly, the invention is related to a system and method for alerting a person of the requirement of washing his/her hands when entering or leaving an area of probable contamination, for reducing the incidence of hospital-acquired infections, food handling contamination, and for reducing other situations in which the acquired contamination of a person's hands is likely to be passed to other personnel.

BACKGROUND OF THE INVENTION

The incidence of hospital acquired (nosocomial) infection is approximately 8% of all hospital in-patients. Nosocomial infections are transmitted by direct or indirect contact between hospital staff and patients. Nosocomial infections are a direct result of inadequate hand hygiene by healthcare workers. It is widely recognized in the infectious diseases specialty that hand hygiene is the simplest and most dollar effective means of preventing these hospital acquired infections. Studies have demonstrated that enforcement of hand hygiene results in a roughly 50% decrease in nosocomial infection rate.

However, hand hygiene is very difficult to enforce and compliance by hospital staff and visitors is uniformly lax. In 1997, an article in the *New England Journal of Medicine* studied the hand-washing rate by hospital staff. Even though the physician, nurses and other staff knew that they were under scrutiny, only 35 to 40% of staff washed their hands regularly in between direct or indirect patient contact. A similar study in *Annals of Internal Medicine* reported hand-washing compliance in 48% of nurses and 35% of physicians. More alarmingly, respiratory therapists washed their hands on only 12% of occasions, and radiology technicians only 8%.

In addition to hospital staff and visitor hand hygiene, there is a need for improving hand hygiene in other public activities, particularly in commercial food handling and food preparation, for reducing the risk of contamination of food consumed by other people.

Thus, a heretofore unaddressed need exists in the industry to reduce nosocomial an other infections.

SUMMARY OF THE INVENTION

Briefly described, the present invention comprises a system and apparatus for alerting a person entering or leaving an area to clean his or her hands. The system includes a bi-directional sensor (e.g. a passive infrared sensor) having first and second sensors spaced horizontally from each other so that the movement of a person passing the sensor is detected and the direction of movement is detected. An alarm, such as a lamp or a sound emitting device, or both, is located on one or more antiseptic dispenser units located in proximity to the sensor. The alarms on the dispenser can be actuated in response to the detection of movement of a person passing the sensor. Activation of the dispenser unit (e.g. by depressing the dispenser lever) simultaneously dispenses an aliquot of disinfectant onto the individuals hands and simultaneously de-activates the alarm system.

For example, when a person moves through the entrance into a hospital room where a patient is being cared for, the sensor detects the movement of the person into the room. Activation of the sensor causes the alarms on the dispenser to be actuated, alerting the person to decontaminate their hands. Once the person activates the dispenser lever, disinfectant is released onto the persons hands, and the alarm is simultaneously de-activated. In addition, or in the alternative, each sensor may be communicatively coupled to one or more dispenser systems. For example, one dispenser system may be located inside the room, while another dispenser system is located outside of the room. This configuration allows for hand decontamination upon both entry and/or exit of the room.

Another feature of the invention is that an alcohol based aerosolized foam or antiseptic solution can be used to clean a persons hands. Alcohol based foams or solutions can be used without the need for a sink or basin. Therefore, this embodiment would avoid the need to have a nearby wash basin and can be used in areas that do not have a wash basin.

Although a primary use of the invention is anticipated to be in health care facilities, other uses can be made of the invention, such as in food handling and food preparation facilities, where hand washing is desirable in certain areas. The invention can be used to demand hand washing before an event, as when the food handler enters the food handling area, or to demand hand washing after an event, as when a person exits a contaminated area.

Another advantage of the invention is that the hand antiseptic system is designed so that it is applicable to use in all hospital room layouts. Further, the hand antiseptic system is bi-directional in that the system is capable of determining if one or more individuals are entering or exiting the particular area. Another advantage is that the hand antiseptic system is capable of sensing multiple targets (two or more individuals entering/exiting the area) and ensuring that each individual decontaminates their hands.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
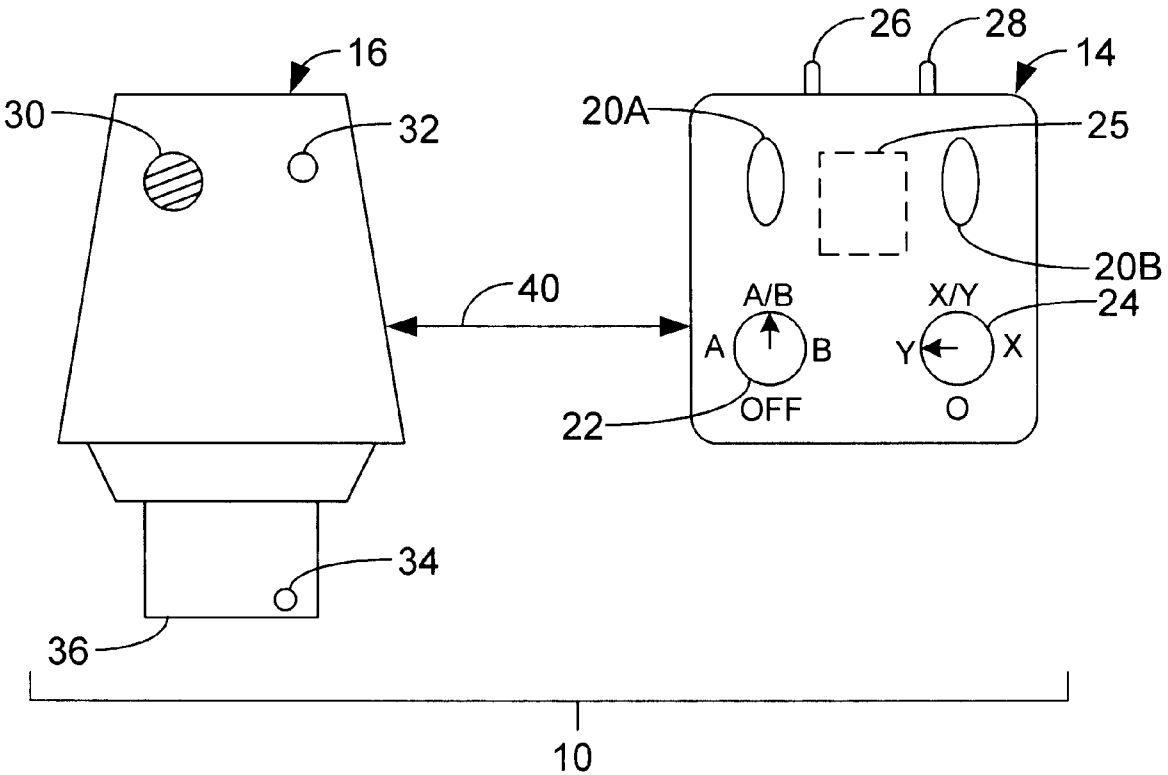
FIG. 1 is a schematic diagram of the components of the hand antiseptic system.

Referring now in more detail to the drawings, in which liken numerals indicate like parts throughout the several views, FIG. 1 illustrates an embodiment of the hand antiseptic system 10. The embodiment illustrated in FIG. 1 includes a bi-directional sensor system 14 and a dispensing system 16. The bi-directional sensor system 14 includes, but is not limited to, one or more sensors 20A and 20B, a computer 25, an alarm selector 22, an alarm mode selector 24, a low power light 26, and an adjustment light 28. The dispensing system 16 can include, but is not limited to, an audible alarm 30, a visual alarm 32, a dispensing detector 34, and a dispensing lever 36. The bi-directional sensor system 14 and the dispensing systems 16 are communicatively coupled 40. Communicatively coupled 40 means that the bi-directional sensor system 14 and a dispensing system 16 can communicate information with one another. This communication can be accomplished via a direct wire connection or through an appropriate wireless communications system, both of which are well known in the art.

The sensors 20A and 20B of the bi-directional sensor system 14 are each capable of sensing infrared energy, or other appropriate energy. The sensing of energy by the sensors 20A and 20B can indicate that targets are passing the sensors 20A and 20B. Generally, the sensors 20A and 20B can sense energy in areas that are usually horizontally spaced from each other so that as the targets pass through each area, the sensors 20A and 20B are triggered sequentially. The computer 25 of the bi-directional sensor system 14 logically understands the sequential triggering of the sensors 20A and 20B to mean that a person has entered/exited the particular area of interest. The sensors 20A and 20B include, but are not limited to, passive infrared sensors, photoelectric proximity sensors, photoelectric ("beam break") sensors, laser sensors, electromagnetic sensors, ultrasonic sensors, and combinations thereof. Each of these sensors 20A and 20B can be bi-directional. More particularly, the sensors 20A and 20B can be Visonic CLIP 3™ sensors. These types of sensors 20A and 20B are well known in the art and will not be discussed in any more detail hereinafter.

As shown in FIG. 1, the bi-directional sensor system 14 includes an alarm selector 22 and an alarm mode selector 24. Generally, the selectors 22 and 24 are four-way selector switches that allow the user to select the functional setup of the bi-directional sensor system 14. The alarm selector 22 allows the user to select the direction of alarm activation; alarm set for individuals entering the room only (A), exiting the room only (B), or both (AB). The alarm selector 22 has an arrow to indicate both the position of the switch and, in two settings, the direction of the movement that will activate the alarm. The fourth or down position of the alarm selector 22 is the "off" switch. The alarm mode selector 24 allows the user to select the nature of the alarm system; audible alarm only (X), visual alarm only (Y), or both audible and visible alarm (XY). The fourth position of the alarm mode selector 24 is the "off" position. Alternatively, the fourth position of the alarm mode selector 24 can be a position that connects to a remote location for alerting a person, such as an attendant at a nurse station of a hospital.

In the event the system is battery powered, the bi-directional sensor system 14 can includes a low power light 26 (FIG. 1) and an equilibrating light 28. The low power light 26 indicates that the bi-directional sensor system 14 is on and is low on power. The equilibrating light 28 indicates that the sensors 20A and 20B of the bi-directional sensor system 14 are adjusting to the energy (e.g. background infrared energy) of the particular area that the bi-directional sensor system 14 is located.

Figure 4:
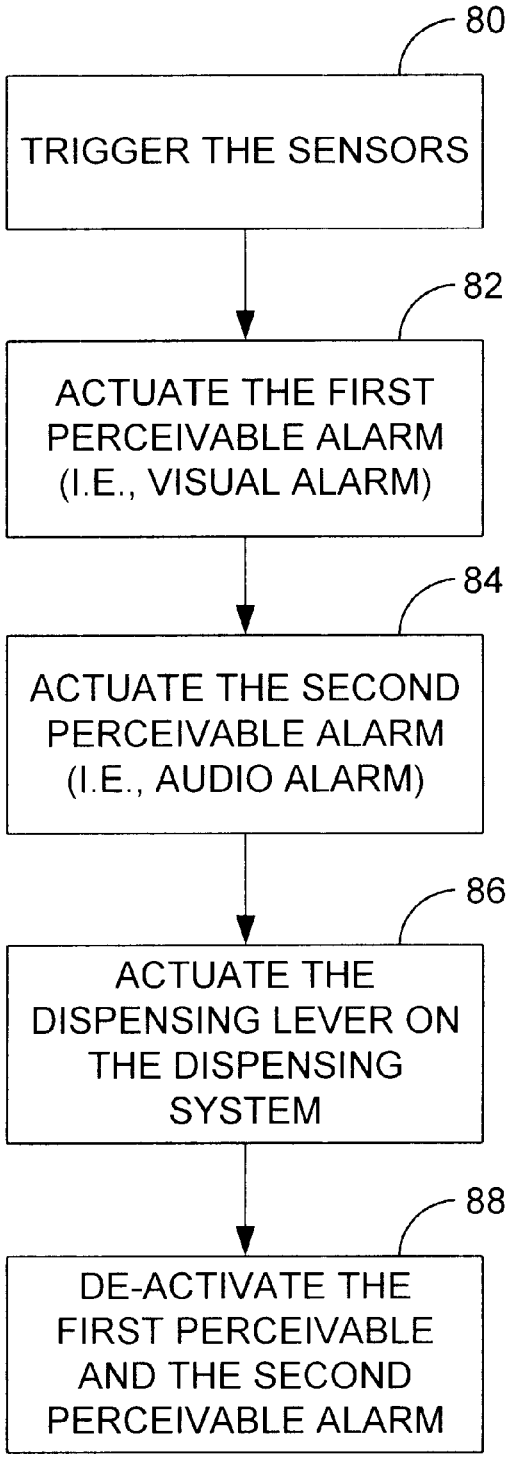
FIG. 4 is a flow diagram illustrating representative functionality of the hand antiseptic system.

The dispensing system 16 includes an audible alarm 30 and a visual alarm 32. The audible alarm 30 indicates that the individual has not disinfected his/her hands. The audible alarm 30 can have various audible alarms, such as, an alarm for an individual or a group of people in the form of a "beep" or pre-recorded message. The visual alarm 32 indicates that the individual has not disinfected his/her hands. The visual alarm 32 can have various blinking modes for particular situations. Generally, once the sensors 20A and 20B of the bi-directional sensor system 14 have been triggered (FIG. 4, block 80) the visual alarm 32 is actuated first, then after a pre-determined period of time the audible alarm 30 is actuated (FIG. 4, blocks 82 and 84). If the audible alarm 40 is not de-activated after a pre-determined time period, the audible alarm 30 is automatically deactivated by a timer to reduce disruption to the patient. Generally, one or more circuits are used to actuate the alarms 20 and 22 and these will be discussed below.

The dispensing system 16 includes an antiseptic substance that can be dispensed via the dispensing lever 36. Pressing the dispenser lever 36 dispenses an aliquot of antiseptic substance to a pre-determined location. The dispensing lever 36 can be a mechanically actuated lever system or a sensor actuated system. Mechanical and sensor actuation systems are well known in the art and will not be expounded upon here. Actuating the dispensing lever 36 de-activates the visual and/or audible alarms 32 and 30 (FIG. 4, blocks 86 and 88), which are discussed in more detail below.

Generally, one or more circuits can be used to interconnect the sensors 20A and 20B, the alarms 30 and 32, and the dispenser lever 36. One function of the circuit is to turn the appropriate alarm 30 and/or 32 on upon the occurrence of a particular event, such as a person triggering the sensors 20A and 20B by walking through the path of the sensors into or out of a particular area. Another function of the circuit is to turn the appropriate alarm 30 and/or 32 off upon the occurrence of a particular event, such as a person actuating the dispensing lever 36. More particularly, upon triggering one or both of the alarms 30 and 32, a gate in a holding circuit is closed, which connects a power source, such as a battery, to one or both alarms 30 and 32, thereby enabling one or both alarms 30 and 32. Alternatively, upon de-activating one or both of the alarms 30 and 32 by actuating the dispensing lever 36, the gate in the holding circuit is opened, which disconnects the power source to one or both alarms 30 and 32, thereby disabling one or both alarms 30 and 32. One skilled in the art of electronics could construct numerous circuit configurations that function to operate the hand antiseptic system 10 and any circuit that can accomplish that function is thereby included herein.

As indicated above, the dispenser system 16 contains a supply of an antiseptic substance or other appropriate cleansing foam, gel, or solution. One embodiment consists of a dispenser system 16 that can accommodate an alcohol based aerosolized foam (e.g. Alcare™, Steris Inc., or E-Z Scrub™ Becton-Dickinson) or antiseptic solution (CalStat™, Steris Inc.). This embodiment would avoid the need for a nearby faucet, hand-sink, or hand-dryer. The dispenser system 16 can be secured to a wall by screw recesses, double-backed adhesive tape, or other appropriate attaching mechanism.

One embodiment of the hand antiseptic system 10 includes a digital camera (still or moving) that is capable of storing an image of individuals entering or exiting the particular area of interest. If the hand antiseptic system 10 is utilized, the image is deleted. If the hand antiseptic system 10 is not utilized, the image is stored for the purpose of identification. Still another embodiment includes an identification system such as a radio frequency identification (RFID) system. Generally, the identification system functions to identify and/or track personnel. More specifically, RFID allows real time identification and tracking of personnel. The system consists of two basic elements: the passive transponder (the ID tag) and the reader. The reader emits a low-frequency magnetic field via an antenna. When a transponder passes within range, it is excited, causing it to transmit its ID code back to the reader. Transmission and reception can occur simultaneously. The tag is incorporated into the ID badges of healthcare workers entering/exiting the particular area of interest. This can also be used to identify individuals not utilizing the hand antiseptic system.

The hand antiseptic system 10 may also include a "sleep" mode, which inactivates the hand antiseptic system 10 for a predetermined time (e.g. 30–60 seconds). A small wireless transmitter could activate the "sleep" mode. The "sleep key" is carried by a few individuals who enter the room, but never have patient contact (e.g. meal deliveries). This feature permits selected individuals time to enter the particular area of interest, perform their task (e.g. leave the food tray) and leave, without activating the alarm.

Replaceable batteries can power the bi-directional sensor system 14 and the dispenser system 16, which precludes the need for an external electrical supply. Alternatively a DC converter unit could supply a constant power source from a nearby AC electrical outlet.

The bi-directional sensory system 14 includes a computer 25 to operate various functions of the hand antiseptic system 10. The computer 25 shown in FIG. 2 may include a processor 50, memory 52, and one or more input and/or output (I/O) devices 54 (or peripherals) that are communicatively coupled via a local interface 53. In addition, the computer 25 can be communicatively coupled to one or more sensors 20A and 20B and one or more dispenser systems 16. The local interface 53 can be, for example but not limited to, one or more buses or other wired or wireless connections, as is known in the art. The local interface 53 may have additional elements, which are omitted for simplicity, such as controllers, buffers (caches), drivers, repeaters, and receivers, to enable communications. Further, the local interface may include address, control, and/or data connections to enable appropriate communications among the aforementioned components.

The processor 50 is a hardware device for executing software that can be stored in memory 52. The processor 50 can be any custom made or commercially available processor, a central processing unit (CPU), an auxiliary processor among several processors associated with the computer 25, a semiconductor based microprocessor (in the form of a microchip or chip set), a macroprocessor, or generally any device for executing software instructions.

The memory 52 can include any one or combination of volatile memory elements (e.g., random access memory (RAM, such as DRAM, SRAM, SDRAM, etc.)) and non-volatile memory elements (e.g., ROM, hard drive, tape, CDROM, etc.). Moreover, the memory 52 may incorporate electronic, magnetic, optical, and/or other types of storage media. Note that the memory 52 can have a distributed architecture, where various components are situated remote from one another, but can be accessed by the processor 50.

Figure 2:
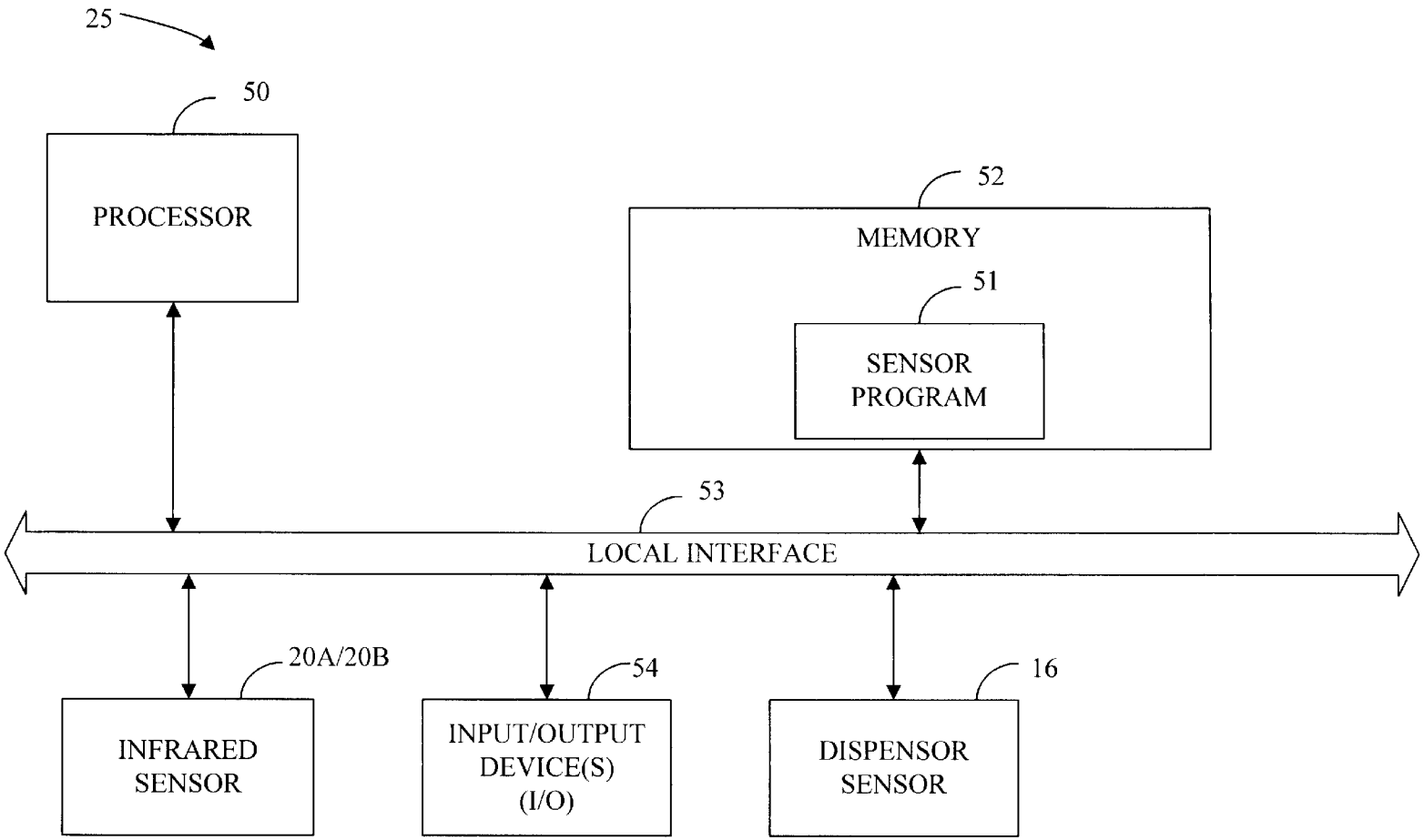
FIG. 2 is a schematic diagram of a computer that is implemented in the hand antiseptic system as shown in FIG. 1.

The software in memory 52 may include one or more separate programs, each of which comprises an ordered listing of executable instructions for implementing logical functions. In the example of FIG. 2, the software in the memory 52 includes the infrared sensor system 51. The sensor program 51 is a source program, executable program (object code), script, or any other entity comprising a set of instructions to be performed.

The I/O devices 54 may include input devices, for example but not limited to, a keyboard, mouse, scanner, microphone, etc. Furthermore, the I/O devices 54 may also include output devices, for example but not limited to, a printer, display, etc. Finally, the I/O devices 54 may further include devices that communicate both inputs and outputs, for instance but not limited to, a modulator/demodulator (modem; for accessing another device, system, or network), a radio frequency (RF) or other transceiver, a telephonic interface, a bridge, a router, etc.

If the computer 25 is a PC, workstation, or the like, the software in the memory 52 may further include a basic input output system (BIOS) (omitted for simplicity). The BIOS is a set of essential software routines that initialize and test hardware at startup, and support the transfer of data among the hardware devices. The BIOS is stored in ROM so that the BIOS can be executed when the computer 25 is activated.

When the computer 25 is in operation, the processor 50 is configured to execute software stored within the memory 52, to communicate data to and from the memory 52, and to generally control operations of the computer 25 pursuant to the software. The sensor program 51 is read by the processor 25, perhaps buffered within the processor 50, and then executed.

When the sensor program 51 is implemented in software, as is shown in FIG. 2, it should be noted that the sensor program 51 can be stored on any computer readable medium for use by or in connection with any computer related system or method. In the context of this document, a computer readable medium is an electronic, magnetic, optical, or other physical device or means that can contain or store a computer program for use by or in connection with a computer related system or method. The infrared system 51 can be embodied in any computer-readable medium for use by or in connection with an instruction execution system, system, or device, such as a computer-based system, processor-containing system, or other system that can fetch the instructions from the instruction execution system, system, or device and execute the instructions. In the context of this document, a "computer-readable medium" can be any means that can store, communicate, propagate, or transport the program for use by or in connection with the instruction execution system, system, or device. The computer readable medium can be, for example but not limited to, an electronic, magnetic, optical, electromagnetic, infrared, or semiconductor system, system, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

In an alternative embodiment, where the sensor program 51 is implemented in hardware, the infrared sensor system can implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

The sensor program 51 operates various features of the hand antiseptic system 10. The function of the sensor program 51 include, but are not limited to, determining if the sensors 20A and 20B have been triggered, determining the sequence that the sensors 20A and 20B were triggered, determining if the dispensing lever 36 has been actuated, determining the number of times the dispensing lever 36 has been actuated, determining the number of targets entering/exiting the area of interest, determining which dispensing system 16 to communicate with, and other operations that enable the hand antiseptic system 10 to function properly.

Figure 3:
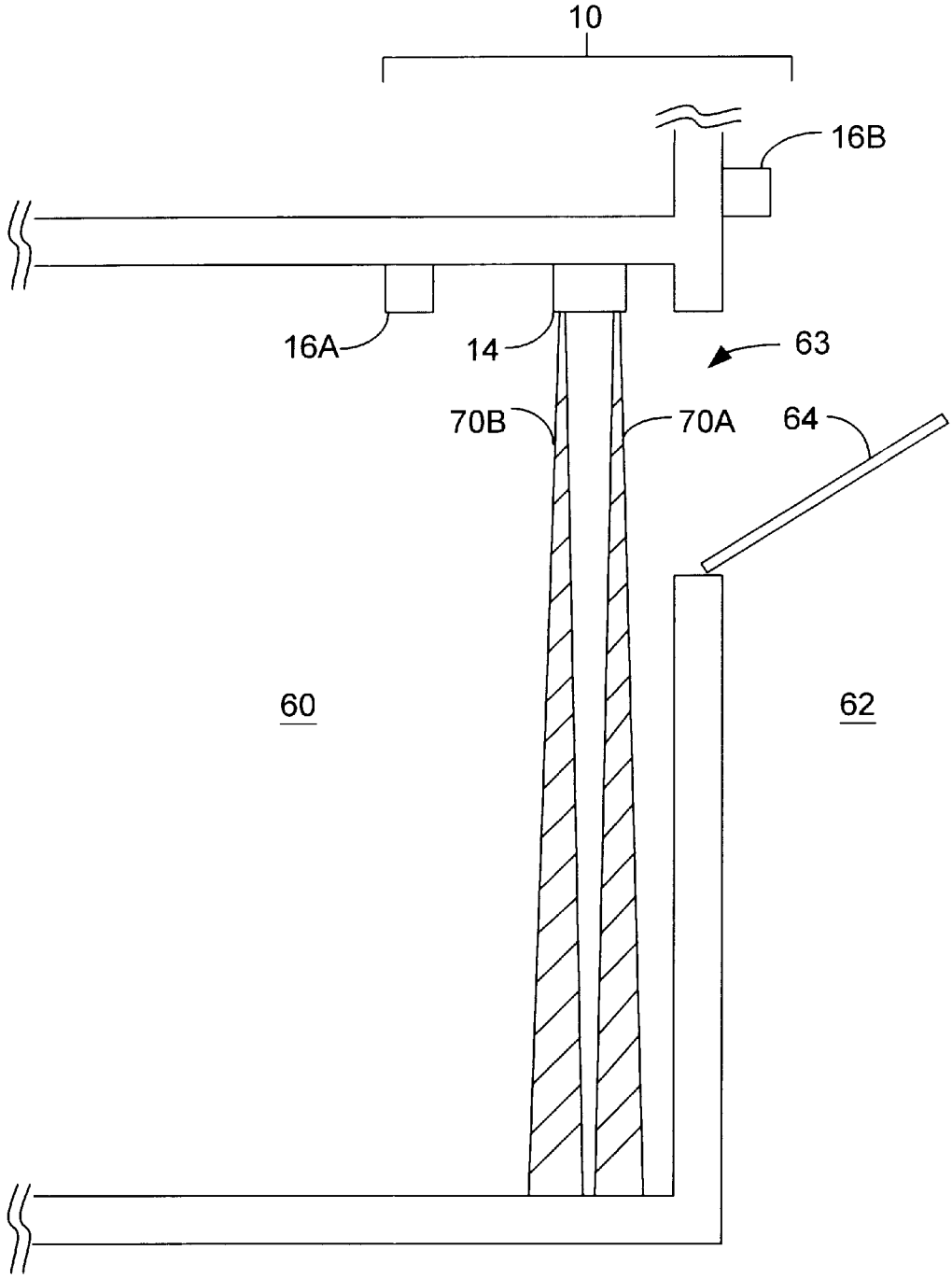
FIG. 3 is a plan view of a room, such as a hospital room, that implements the hand antiseptic system that is shown in FIG. 1.

FIG. 3 is a plan view of one embodiment of the hand antiseptic system 10. A sensitive area 60 (e.g. a hospital room or intensive care room) and a second area 62 (e.g. hallway or other room) are separated by a wall with an entrance 63 that typically includes a door 64. The hand antiseptic system 10 can be used to ensure hand decontamination upon movement through the entrance 63 from one area to another. In the embodiment illustrated in FIG. 3, the hand antiseptic system 10 includes a bi-directional sensor system 14 and two dispensing systems 16A and 16B. One dispensing system 16A is on one side of the entrance 63, while the other dispensing system 16B is on the other side of the entrance. Other embodiments can include one or more bi-directional sensor systems 14 and one or more dispensing systems 16. The bi-directional sensor system 14 typically is located inside the sensitive area 60 near the entrance 63 to the sensitive area 60. The bi-directional sensor system 14 can be located on a wall, as is shown in FIG. 3, or located on the ceiling.

FIG. 3 also depicts the two dispensing systems 16A and 16B in two different areas 60 and 62. In this embodiment, dispensing system 16A is located in the sensitive area 60 and is used by individuals entering the sensitive area 60, while dispensing system 16B is located in the second area 12 for individuals exiting the sensitive area 60 and entering the second area 62.

Generally, the bi-directional sensor system 14 includes two sensors 20A and 20B (e.g. passive infrared sensors) positioned serially. Each sensor 20A and 20B is capable of sensing infrared energy in sensor areas 70A and 70B. An individual entering the sensitive area 60 passes through the second sensor area 70B, which triggers the second sensor 20B. Then the individual passes through the first sensor area 70A, which triggers the first sensor 20A. This sequence of triggering the sensors 20B and 20A indicates that the individual is entering into the sensitive area 60. More particularly, the sensor program 51 of the computer 25, based upon the triggering sequence, is capable of determining that an individual is entering the sensitive area 60 and communicates this to dispenser system 16A. Conversely, an individual exiting the sensitive area 60 passes thought the first sensor area 70A, which triggers the first sensor 20A. Then the individual passes through the second sensor area 70B, which triggers the second sensor 20B. This triggering sequence of the sensors 20A and 20B indicates that the individual is exiting the sensitive area 60 and moving into the second area 62. More particularly, the sensor program 51 of the computer 25, based upon the triggering sequence, is capable of determining that an individual is exiting the sensitive area 60 and communicates this to dispenser system 16B.

The following is an example of how the hand antiseptic system 10 can operate when an individual enters the sensitive area 60. This scenario would occur when a patient with indwelling devices, such as central lines, are uniquely susceptible to external infection from the hospital environment, and these individuals require protection from external pathogens. In this scenario, hand decontamination is required upon entry to the sensitive area 60. The alarm selector 22 is set for targets entering the sensitive area 60. The visual alarm 32 on the dispensing system 16A is actuated once both sensors 20B and 20A of the bi-directional sensor system 14 are triggered by an individual entering the sensitive area 60 of a patient. Upon actuation, the visual alarm 32 blinks for a pre-determined time period (e.g. five seconds). More specifically, the computer 25 instructs the bi-directional sensor system 14 to communicate with the dispensing system 16A to trigger the visual alarm 32 to blink for a pre-determined time period. The visual alarm 32 can be de-activated when the dispensing sensor 34 on the dispensing system 16A is actuated. The dispensing sensor 34 can be actuated by triggering (e.g. depressing) the dispenser lever 36. Upon actuation of the dispensing sensor 34, the visual alarm 32 is de-activated.

If the visual alarm 32 is not de-activated within the predetermined time period, the audible alarm 30 is activated to alert the individual to decontaminate their hands. The audible alarm 30 audibly alerts (e.g. beep or play a recorded message) the individual that their hands need to be decontaminated using the dispenser system 16A. Like the visual alarm 32, the audible alarm is de-activated when dispensing sensor 34 on the dispensing system 16A is actuated. The dispensing sensor 34 can be actuated by triggering the dispenser lever 36. Upon actuation of the dispensing sensor 34, the audible alarm 30 and the visual alarm 32 are de-activated.

The following is an example of how the hand antiseptic system 10 can operate when an individual exits the sensitive area 60 and goes into the second area 62. This scenario would occur when a patient with active wound infections represent a potentially catastrophic source of cross-infection to other patients, and strict hand decontamination is required by all personnel exiting the sensitive area, to prevent spread of infection to other individuals. This is particularly important in the setting of infection by antibiotic resistant organisms, such as methicillin resistant staphylococcus aureus (MRSA) or vancomycin resistant enterococcus (VRE). The alarm selector 22 is set for targets exiting the sensitive area 60. In this scenario, the visual alarm 32 on the dispensing system 16B is actuated once both sensors 20A and 20B on the bi-directional sensor system 14 are triggered by an individual exiting the sensitive area 60 of a patient. Upon actuation, the visual alarm 32 blinks for a pre-determined time period (e.g. five seconds). More specifically, the computer 25 instructs the bi-directional sensor system 14 to communicate with the dispensing system 16B to trigger the visual alarm 32 to blink for a pre-determined time period. The visual alarm 32 can be de-activated when the dispensing sensor 34 on the dispensing system 16B is actuated. The dispensing sensor 34 can be actuated by triggering (e.g. depressing) the dispenser lever 36. Upon actuation of the dispensing sensor 34, the visual alarm 32 is de-activated.

If the visual alarm 32 is not de-activated within the predetermined time period, the audible alarm 30 is activated to audibly alert the individual to decontaminate their hands. Like the visual alarm 32, the audible alarm is de-activated when the dispensing sensor 34 on the dispensing system 16B is actuated. The dispensing sensor 34 can be actuated by triggering the dispenser lever 36. Upon actuation of the dispensing sensor 34, the audible alarm 30 and the visual alarm 32 are de-activated.

The examples above illustrate how the hand antiseptic system 10 can be used for an individual entering or exiting a sensitive area 60. Another example would combine the use of the hand antiseptic system 10 for both entering and exiting the sensitive area 60 in a manner similar to the previous two examples. This scenario would occur when strict isolation precautions are required for immunocompromised patients, such as bone marrow transplants or other transplant patients. This scenario would require hand decontamination on both entry and exit to the sensitive area 60. In this scenario the alarm selector 22 is set for targets entering and exiting the sensitive area 60. The hand antiseptic system 10 operates in a manner similar to the previous examples except that once the individual who has entered the sensitive area 60 has de-activated the alarm 32 and/or 30, the hand antiseptic system 10 resets the sensors 20A and 20B. The resetting occurs so that the hand antiseptic system 10 can determine when the individual is exiting the sensitive area 60 and appropriately alert the individual upon leaving the sensitive area 60 to decontaminate their hands. In another example where the sensitive area 60 is empty, with no patient currently being treated, the hand antiseptic system 10 could be inactivated by turning the alarm selector 22 to the "off" position.

Another embodiment of the hand antiseptic system 10 provides the capability of determining the number of individual entering/exiting the sensitive area 60 and generating an appropriate visual and/or audible alarm 32 and 30, which depends upon the number of individuals entering/exiting the sensitive area 60. In general, if "n" number of individuals enter/exit the sensitive area 60, then "n" number of visual and/or audible alarms can be activated. More specifically, in the event a single individual is identified, a single, repeating visible stimulus ("blink") and/or audible stimulus (a "beep") is generated. Alternatively, in the event that two individuals are identified, two repeating visual and/or audible stimuli are generated. The hand antiseptic system 10 can be further modified to determine the number of times the dispenser lever 36 of the dispenser system 16A and 16B is depressed. The computer 25 of the bi-directional sensor system 14 is capable of determining the number of individuals detected and the number of individuals having decontaminated their hands. The computer 25 then derives a "net" number of individuals that need to decontaminate their hands, and generates a visual and/or audible alarm 32 and 30 to indicate that a certain number of individuals need to decontaminate their hands. For example, if one individual is identified, a single actuation of the dispenser lever 36 can de-activate the alarm completely. If two individuals are identified, a single activation of the dispenser lever 36 can alter the visual and/or audible alarm 32 and 30 into an appropriate visual and/or audible alarm 32 and 30 indicating that only one individual still needs to decontaminate their hands. A second activation of the dispenser lever 36 can de-activate the alarm completely. A one-to-one ratio of people entering/exiting the sensitive area 60 and decontaminating their hands is therefore provided. In this manner, full compliance with hand decontamination by all individuals entering/leaving the sensitive area 60 can be achieved.

Many variations and modifications may be made to the hand antiseptic system and method 10 without departing substantially from the spirit and principles of the invention. All such modifications and variations are intended to be included herein within the scope of this disclosure and the invention and protected by the following claims.

Therefore, having thus described the invention, at least the following is claimed:

1. A hand antiseptic system for encouraging hand hygiene procedures, comprising:

a bi-directional sensor that includes a first sensor and a second sensor that are both affixed to the bi-directional sensor system and are horizontally positioned in series with one another on the bi-directional sensor system, wherein the first sensor can sense a person in a first sensor area, wherein the second sensor can sense the person in a second sensor area, wherein a person can trigger the first sensor by passing through the first sensor area, wherein the person can trigger the second sensor by passing through the second sensor area, and wherein the bi-directional sensor system is capable of determining the direction that the person is moving by the order in which the first sensor and second sensor are triggered; and a dispensing system that includes:

a first perceivable alarm actuated by the person passing through the first sensor area and the second sensor area and triggering the first sensor and the second sensor;

a second perceivable alarm actuated if the first perceivable alarm is not de-activated after a predetermined time period; and a dispensing detector, wherein the first perceivable alarm is deactivated after the dispensing detector is triggered, and wherein the second perceivable alarm is deactivated after the dispensing detector is triggered.

2. The system of claim 1, wherein the dispensing system dispenses a hand hygiene agent when the dispensing detector is triggered.

3. The system of claim 1, wherein the dispensing system includes a first dispensing system and a second dispensing system, wherein the first dispensing system is located in a first area and the second dispensing system is located in an adjacent second area and wherein the bi-directional sensor system is located in the first area.

4. The system of claim 3, wherein the bi-directional sensor system is capable of activating the first dispensing system if the first sensor is triggered before the second sensor.

5. The system of claim 3, wherein the bi-directional sensor system is capable of activating the second dispensing system if the second sensor is triggered before the first sensor.

6. The system of claim 1, wherein the bi-directional sensor system is capable of determining the number of targets entering an area.

7. The system of claim 1, wherein the bi-directional sensor system is capable of determining the number of targets exiting an area.

8. The system of claim 1, wherein the bi-directional sensor system includes a digital camera.

9. The system of claim 1, wherein the bi-directional sensor system includes a sleep mode.

10. The system of claim 1, wherein the bi-directional sensor system includes a radio frequency identification system.

11. The system of claim 1, wherein the first sensor and the second sensor are selected from passive infrared sensors, photoelectric proximity sensors, photoelectric sensors, laser sensors, electromagnetic sensors, and ultrasonic sensors.

12. The system of claim 1, wherein the first sensor and the second sensor include a passive infrared sensor.

13. A method of alerting a person entering an area to clean their hands using a hand antiseptic system that includes a bi-directional sensor system having a first sensor and a second sensor that are both affixed to the bi-directional sensor system and are horizontally positioned in series with one another on the bi-directional sensor system, wherein the first sensor can sense a person in a first sensor area, and wherein the second sensor can sense the person in a second sensor area, comprising the steps of:

triggering a first sensor when the person passes through the first sensor area;

triggering a second sensor when the person passes through the second sensor area;

actuating a first alarm when the first sensor and second sensor are triggered in sequence and where the first sensor is triggered before the second sensor; and actuating a second alarm after a predetermined time period has lapsed after the first alarm was actuated.

14. The method of claim 13, further comprising the steps of:

resetting the first sensor and the second sensor;

resetting the first alarm and second alarm;

resetting the time period;

triggering a second sensor when the person passes through the first sensor area;

triggering a first sensor when the person passes through the second sensor area;

actuating a first alarm when the second sensor and first sensor are triggered in sequence and where the second sensor is triggered before the first sensor; and actuating a second alarm after a predetermined time period has lapsed after the first alarm was actuated.

15. The method of claim 14, further comprising the step of deactivating the first alarm if a dispenser lever is activated.

16. The method of claim 14, further comprising the step of deactivating the first and second alarm if a dispenser lever is activated.

17. The method of claim 14, wherein the bi-directional sensor system is capable of determining the number of targets exiting an area.

18. The method of claim 13, wherein the bi-directional sensor system is capable of determining the number of targets entering an area.

19. A method of alerting a person exiting an area to clean their hands using a hand antiseptic system that includes a bi-directional sensor system having a first sensor and a second sensor that are both affixed to the bi-directional sensor system and are horizontally positioned in series with one another on the bi-directional sensor system, wherein the first sensor can sense a person in a first sensor area, and wherein the second sensor can sense the person in a second sensor area, comprising the steps of:

triggering a second sensor when the person passes through the second sensor area;

triggering a first sensor when the person passes through the first sensor area;

actuating a first alarm when the second sensor and first sensor are triggered in sequence and where the second sensor is triggered before the first sensor; and actuating a second alarm after a predetermined time period has lapsed after the first alarm was actuated.

20. The method of claim 19, further comprising the step of deactivating the first alarm if a dispenser lever is activated.

21. The method of claim 19, further comprising the step of deactivating the first and second alarm if a dispenser lever is activated.

22. The method of claim 19, wherein the bi-directional sensor system is capable of determining the number of targets exiting an area.

23. A system of alerting a person entering an area to clean their hands using a hand antiseptic system that includes a bi-directional sensor system having a first sensor and a second sensor that are both affixed to the bi-directional sensor system and are horizontally positioned in series with one another on the bi-directional sensor system, wherein the first sensor can sense a person in a first sensor area, and wherein the second sensor can sense the person in a second sensor area, comprising:

triggering a first sensor when the person passes through the first sensor area;

triggering a second sensor when the person passes through the second sensor area;

means for actuating a first alarm when the first sensor and second sensor are triggered in sequence and where the first sensor is triggered before the second sensor; and means for actuating a second alarm after a predetermined time period has lapsed after the first alarm was actuated.

24. The system of claim 23, further comprising:

means for resetting the first sensor and the second sensor;

means for resetting the first alarm and second alarm;

means for resetting the time period;

triggering a second sensor when the person passes through the first sensor area;

triggering a first sensor when the person passes through the second sensor area;

means for actuating a first alarm when the second sensor and first sensor are triggered in sequence and where the second sensor is triggered before the first sensor; and means for actuating a second alarm after a predetermined time period has lapsed after the first alarm was actuated.

25. A method of alerting a person exiting an area to clean their hands using a hand antiseptic system that includes a bi-directional sensor system having a first sensor and a second sensor that are both affixed to the bi-directional sensor system and are horizontally positioned in series with one another on the bi-directional sensor system, wherein the first sensor can sense a person in a first sensor area, and wherein the second sensor can sense the person in a second sensor area, comprising the steps of:

triggering a second sensor when the person passes through the second sensor area;

triggering a first sensor when the person passes through the first sensor area;

means for actuating a first alarm when the second sensor and first sensor are triggered in sequence and where the second sensor is triggered before the first sensor; and means for actuating a second alarm after a predetermined time period has lapsed after the first alarm was actuated.

* * * * *